US009096811B2

(12) United States Patent
Smithers et al.

(10) Patent No.: US 9,096,811 B2
(45) Date of Patent: Aug. 4, 2015

(54) FUNCTIONAL FLUID COMPOSITION

(75) Inventors: Janet Marian Smithers, Ince Chester Cheshire (GB); David John Wedlock, Ince Chester Cheshire (GB)

(73) Assignee: Shell Oil Company, Houston, TX (US)

( * ) Notice: Subject to any disclaimer, the term of this patent is extended or adjusted under 35 U.S.C. 154(b) by 428 days.

(21) Appl. No.: 13/505,850

(22) PCT Filed: Nov. 4, 2010

(86) PCT No.: PCT/EP2010/066843

§ 371 (c)(1),
(2), (4) Date: May 24, 2012

(87) PCT Pub. No.: WO2011/054909

PCT Pub. Date: May 12, 2011

(65) Prior Publication Data

US 2012/0231986 A1 Sep. 13, 2012

(51) Int. Cl.
*C10M 111/04* (2006.01)

(52) U.S. Cl.
CPC ..... *C10M 111/04* (2013.01); *C10M 2203/1006* (2013.01); *C10M 2203/1065* (2013.01); *C10M 2203/1085* (2013.01); *C10M 2205/173* (2013.01); *C10N 2220/022* (2013.01); *C10N 2220/023* (2013.01); *C10N 2220/025* (2013.01); *C10N 2230/02* (2013.01); *C10N 2230/06* (2013.01); *C10N 2230/10* (2013.01); *C10N 2230/40* (2013.01); *C10N 2230/52* (2013.01); *C10N 2240/102* (2013.01)

(58) Field of Classification Search
USPC ..... 508/591, 110
See application file for complete search history.

(56) References Cited

U.S. PATENT DOCUMENTS

| | | | | |
|---|---|---|---|---|
| 3,390,083 | A | 6/1968 | Lion | |
| 2004/0094453 | A1 * | 5/2004 | Lok et al. | 208/19 |
| 2007/0193535 | A1 | 8/2007 | Garner et al. | |
| 2008/0287327 | A1 * | 11/2008 | Mayhew et al. | 508/186 |

FOREIGN PATENT DOCUMENTS

| | | | |
|---|---|---|---|
| EP | 0668342 | 8/1995 | C10G 65/04 |
| EP | 0776959 | 6/1997 | C10G 65/04 |
| EP | 1029029 | 4/1999 | C10M 143/08 |
| WO | WO9721788 | 6/1997 | C10G 67/04 |
| WO | WO0041332 | 8/1999 | C10G 69/02 |
| WO | WO0008115 | 2/2000 | C10G 45/58 |
| WO | WO0014179 | 3/2000 | C10G 2/00 |
| WO | WO0014183 | 3/2000 | C10G 45/58 |
| WO | WO0014187 | 3/2000 | |
| WO | WO0014188 | 3/2000 | C10M 105/04 |
| WO | WO0015736 | 3/2000 | C10G 65/00 |
| WO | WO0118156 | 3/2001 | C10M 101/02 |
| WO | WO0157166 | 8/2001 | C10G 65/12 |
| WO | WO03027210 | 3/2003 | C10G 71/00 |
| WO | WO2004007647 | 1/2004 | C10G 45/64 |
| WO | WO2006094264 | 9/2006 | |
| WO | 2007003623 | 1/2007 | |
| WO | WO2007003623 | 1/2007 | C10M 111/00 |

OTHER PUBLICATIONS

Sequeira, A, Jr. ; "Lubricant Base Oil and Wax Processing"; Marcel Dekker, Inc.; pp. 28-35; 1994.
Laszlo, Carlo; "Napthenic Oils Compensate for Deficit of Group 1 Oils"; Naphthenic Magazine; Retrieved from Internet website URL:http//www2.nynas.com/naph/start/index_iss.cfm?Iss_ID=111&Lan_ID=3; Retrieved Dec. 20, 2010.

* cited by examiner

*Primary Examiner* — James Goloboy

(57) ABSTRACT

A functional fluid composition comprising a naphthenic bright stock base oil and a Fischer-Tropsch derived base oil, wherein the functional fluid composition has a Viscosity Index (according to ASTM D 2270) of above 95.

20 Claims, No Drawings

FUNCTIONAL FLUID COMPOSITION

PRIORITY CLAIM

The present application is a U.S. national stage entry of PCT/US 2009/066843, filed 4 Nov. 2010, which claims priority from European Application EP 09175114.9, filed 5 Nov. 2009, both of which are incorporated by reference.

FIELD OF THE INVENTION

The present invention relates to a functional fluid composition for particular use as a lubricating composition in engines operated under sustained high load conditions, such as in marine diesel engines and power applications. More particularly the present invention relates to a functional fluid for use as a marine cylinder oil in marine diesel engines.

BACKGROUND OF THE INVENTION

It is to be noted that, although the present invention has been explained below whilst referring to a functional fluid for particular use as a marine cylinder oil, the present invention is not limited in any way to such a marine cylinder oil; the present invention can be equally applied to lubricating composition intended for other applications.

Marine cylinder oils used in marine diesel engines are subject to particularly high levels of stress due to the fact that marine diesel engines are usually run continuously at near full load conditions at high temperatures and pressures for long periods of time.

Marine cylinder oils are so-called "total loss" compositions and their purpose is to provide a strong oil film between the cylinder liner and piston rings. If the oil film breaks down under the high operating temperatures and pressure, the internal walls of the cylinder will be subjected to adhesive wear (known as "scuffing").

Apart from providing a strong oil film between the cylinder liner and piston rings, the marine cylinder oil is typically formulated to provide for good oxidation and thermal stability, water demulsibility, corrosion protection and good antifoam performance.

SUMMARY OF THE INVENTION

It is an object of the present invention to provide an alternative functional fluid composition, in particular an alternative marine cylinder oil formulation.

To this end, the present invention provides a functional fluid composition comprising:

a naphthenic bright stock base oil; and a Fischer-Tropsch derived base oil, wherein the functional fluid composition has a Viscosity Index (according to ASTM D 2270) of above 95.

DETAILED DESCRIPTION OF THE PREFERRED EMBODIMENTS

It has been surprisingly been found according to the present invention that a naphthenic bright stock base oil can be used in functional fluids such as a marine cylinder oil, whilst obtaining desirable VI, oxidation stability and antiwear properties. Although the use of paraffinic bright stock base oil in cylinder oils has been suggested in the past, the use of naphthenic bright stock base oils would presently be deemed unsuitable in view of the relative weak oil film and poor oxidation stability properties thereof; the poor oxidation stability properties of a naphthenic bright stock based cylinder oil has been exemplified in Comparative Example 4 hereinafter.

In this respect it is noted that recently published WO 2007/003623 A1 discloses a cylinder oil formulation for use in slow speed diesel engines comprising:

(i) a bright stock base oil blend comprising a paraffinic base oil component having a viscosity at 100° C. of from 8 to 25 $mm^2$/sec, and a mineral derived residual and de-asphalted oil component;

(ii) a paraffinic base oil component or a hazy paraffinic base oil component; and (iii) one or more additives selected from dispersants, overbased detergents, antiwear agents, friction reducing agents, viscosity improvers, viscosity thickeners, metal passivators, acid sequestering agents and antioxidants. However, no naphthenic bright stock base oil has been suggested in WO 2007/003623 A1.

There are no particular limitations regarding the naphthenic bright stock base oil as used in the functional fluid compositions according to the present invention. Typically, naphthenic bright stock base oils are residual base oils from naphthenic vacuum residua obtained by refinery processes starting from naphthenic mineral crude feeds (typically, mineral crude feeds having a TAN (Total Acid Number; ASTM D 664) value of above 0.5 mg KOH/g are naphthenic and below 0.5 mg KOH/g are paraffinic); no dewaxing step takes place in the preparation of naphthenic bright stock base oils (contrary to the preparation of a paraffinic base oil in which a dewaxing step is needed). Mineral-derived bright stock base oils are well known and described in more detail in "Lubricant base oil and wax processing", Avilino Sequeira, Jr., Marcel Dekker, Inc, New York, 1994, ISBN 0-8247-9256-4, pages 28-35. Preferably, the naphthenic bright stock base oil as used according to the present invention has an initial boiling point (true boiling point according to ASTM D 2887) of above 380° C., preferably above 400° C., more preferably above 420° C. Also, the naphthenic bright stock base oil preferably has an aromatic atomic content $C_A$ (according to ASTM D 3238) of below 2 wt. % (for a paraffinic base oil this is typically above 2 wt. %).

Commercially available sources of naphthenic bright stock base oils include those commercially available from Ergon Petroleum Specialties (Jackson, Miss., USA), e.g. under the trade designation "Hyprene V150BS".

Preferably, the naphthenic bright stock base oil has a pour point of below −9° C., preferably below −12° C. (according to ASTM D 5950).

Further it is preferred that the naphthenic bright stock base oil has a Viscosity Index (according to ASTM D 2270) of below 97, preferably below 95, more preferably below 90, even more preferably below 85.

There are no particular limitations regarding the Fischer-Tropsch derived base oil as used in the functional fluid compositions according to the present invention.

Fischer-Tropsch derived base oils are known in the art. By the term "Fischer-Tropsch derived" is meant that a base oil is, or is derived from, a synthesis product of a Fischer-Tropsch process. A Fischer-Tropsch derived base oil may also be referred to as a GTL (Gas-To-Liquids) base oil. Suitable Fischer-Tropsch derived base oils that may be conveniently used as the base oil in the functional fluid compositions of the present invention are those as for example disclosed in EP 0 776 959, EP 0 668 342, WO 97/21788, WO 00/15736, WO 00/14188, WO 00/14187, WO 00/14183, WO 00/14179, WO 00/08115, WO 99/41332, EP 1 029 029, WO 01/18156 and WO 01/57166.

Typically, the Fischer-Tropsch derived base oil as used according to the present invention has a kinematic viscosity at 100° C. (according to ASTM D 445) of between 2.0 and 25.0 cSt. According to the present invention the Fischer-Tropsch derived base oil preferably has a kinematic viscosity at 100° C. of at least 3.0 cSt (according to ASTM D445), preferably at least 4.0 cSt and more preferably at least 7.0 cSt. In the event the base oil contains a blend of two or more base oils, it is preferred that the total contribution of the base oil to this kinematic viscosity is as indicated (between 2.0 and 25.0 cSt, etc.).

The functional fluid composition according to the present invention may—in addition to the naphthenic bright stock base oil and the Fischer-Tropsch derived base oil—additionally contain mixtures of one or more other mineral oils and/or one or more synthetic oils. Mineral oils include liquid petroleum oils and solvent-treated or acid-treated mineral lubricating oil of the paraffinic, naphthenic, or mixed paraffinic/naphthenic type which may be further refined by hydrofinishing processes and/or dewaxing.

Suitable additional base oils for use in the functional fluid composition of the present invention are Group I-III mineral base oils, Group IV poly-alpha olefins (PAOs) and mixtures thereof.

By "Group I", "Group II", "Group III" and "Group IV" base oils in the present invention are meant lubricating oil base oils according to the definitions of American Petroleum Institute (API) for category I, II, III and IV. These API categories are defined in API Publication 1509, 15th Edition, Appendix E, Apr. 2002.

Synthetic oils include hydrocarbon oils such as olefin oligomers (including polyalphaolefin base oils; PAOs), dibasic acid esters, polyol esters, polyalkylene glycols (PAGs), alkyl naphthalenes and dewaxed waxy isomerates. Synthetic hydrocarbon base oils sold by the Shell Group under the designation "Shell XHVI" (trade mark) may be conveniently used.

The total amount of base oil (i.e. naphthenic bright stock base oil, Fischer-Tropsch derived base oil and any additional base oils) incorporated in the functional fluid composition of the present invention is preferably in the range of from 60 to 99.9 wt. %, more preferably in the range of from 70 to 98 wt. % and most preferably in the range of from 80 to 96 wt. %, based on the total weight of the functional fluid composition.

As mentioned above, the functional fluid composition according to the present invention has a Viscosity Index (according to ASTM D 2270) of above 95, preferably above 100.

Further it is preferred that the composition has a Total Base Number (TBN) value (according to ASTM D 4739) of above 35 and below 75 mg KOH/g, preferably between 45 and 70 mg KOH/g.

The functional fluid composition according to the present invention may further comprise one or more additives such as anti-oxidants, anti-wear additives, (preferably ashless) dispersants, detergents, extreme-pressure additives, friction modifiers, metal deactivators, corrosion inhibitors, demulsifiers, anti-foam agents, seal compatibility agents and additive diluent base oils, etc.

As the person skilled in the art is familiar with the above and other additives, these are not further discussed here in detail. Specific examples of such additives are described in for example Kirk-Othmer Encyclopedia of Chemical Technology, third edition, volume 14, pages 477-526.

The functional fluid compositions of the present invention may be conveniently prepared by admixing the one or more additives with the base oil(s).

The above-mentioned additives are typically present in an amount in the range of from 0.01 to 35.0 wt. %, based on the total weight of the functional fluid composition, preferably in an amount in the range of from 0.05 to 25.0 wt. %, more preferably from 1.0 to 20.0 wt. %, based on the total weight of the functional fluid composition.

Preferably, the functional fluid composition according to the present invention comprises less than 1.0 wt. % of polyisobutylene (PIB), preferably less than 0.5 wt. %. Also it is preferred that the functional fluid composition comprises at least 20 wt. % of the naphthenic bright stock base oil, preferably at least 25 wt. %, more preferably at least 30 wt. %, based on the total weight of the composition. Further it is preferred that the lubricating composition comprises less than 5.0 wt. % of any other additives than one or more detergents.

Preferably the functional fluid composition according to the present invention is a marine cylinder oil.

In another aspect, the present invention provides the use of a functional fluid composition according to the present invention in order to improve anti-oxidation properties (in particular according to ASTM D 2272).

The present invention is described below with reference to the following Examples, which are not intended to limit the scope of the present invention in any way.

EXAMPLES

Functional Fluid Compositions

Various functional fluid compositions for use as SAE 50 marine cylinder oils (meeting the so-called SAE J300 Specifications as revised in January 2009; SAE stands for Society of Automotive Engineers) in a marine diesel engine were formulated.

Table 1 indicates the properties for the base oils used. Table 2 indicates the composition and properties of the fully formulated marine cylinder oil compositions that were tested; the amounts of the components are given in wt. %, based on the total weight of the compositions.

All tested marine cylinder oil compositions contained a combination of a base oil mixture and an additive package (which additive package was the same in all tested compositions).

The "Additive package" was a special performance package for marine cylinder oils and contained a combination of performance additives including an anti-rust agent, a dispersant, a demulsifier and an overbased detergent.

"Base oil 1" was a naphthenic bright stock base oil. Base oil 1 is commercially available from e.g. PetroChina (Karamay, China) under the trade designation "Karamay BS").

"Base oil 2" was a Fischer-Tropsch derived base oil ("GTL 3") having a kinematic viscosity at 100° C. (ASTM D445) of approx. 3 cSt (1 cSt corresponds to 1 $mm^2s^{-1}$). GTL 3 may be conveniently manufactured by or similar to the process described in e.g. WO 2004/07647, the teaching of which is hereby incorporated by reference.

"Base oil 3" was a Fischer-Tropsch derived base oil ("GTL 4") having a kinematic viscosity at 100° C. (ASTM D445) of approx. 4 cSt.

"Base oil 4" was a Fischer-Tropsch derived base oil ("GTL 8") having a kinematic viscosity at 100° C. (ASTM D445) of approx. 8 cSt.

These GTL 4 and GTL 8 base oils may be conveniently manufactured by or similar to the process described in e.g. WO 02/070631, the teaching of which is hereby incorporated by reference.

"Base oil 5" and "Base oil 6" were commercially available Group I base oils from mineral origin. Base oils 5 and 6 are sold by Shell Base oils (Shell Centre, London, UK) under the trade designation "HVI 130" and "HVI 650", respectively.

"Base oil 7" was a commercially available Polybutene (PIB) base oil, available from INEOS Oligomers (Lavera, France) under the trade designation "Indopol H-7".

The compositions of Examples 1-3 and Comparative Example 1 were obtained by mixing the base oils with the additive package using conventional lubricant blending procedures.

Oxidation Stability

In order to demonstrate the oxidation properties of the compositions according to the present invention, oxidation stability measurements were performed according to the industry standard RPVOT test (at 150° C.) of ASTM D 2272. The measured values (in min) are indicated in Table 3 below.

Wear Performance

In order to demonstrate the wear properties of the compositions according to the present invention, wear measurements were performed according to the industry standard 4-ball wear test of IP-239-4 (load 60 kg; time: 60 min; speed: 1500 rpm; temp: 75° C.). The measured wear scars (in mm) according to IP-239-4 are indicated in Table 3 below.

TABLE 1

| | Base oil 1 (naphthenic bright stock) | Base oil 2 (GTL 3) | Base oil 3 (GTL 4) | Base oil 4 (GTL 8) | Base oil 5 (HVI 130) | Base oil 6 (HVI 650) | Base oil 7 (Indopol H-7) |
|---|---|---|---|---|---|---|---|
| Kinematic viscosity at 100° C.[1] [cSt] | 32.7 | 2.66 | 3.98 | 7.60 | 9.17 | 31.9 | 11.49 |
| Kinematic viscosity at 40° C.[1] [cSt] | 607.1 | 9.40 | 17.22 | 43.09 | 73.55 | 484.0 | 104.5 |
| VI Index[2] | 82 | 123 | 131 | 145 | 99 | 96 | 96 |
| Pour point[3] [° C.] | −15 | −42 | −36 | −24 | −9 | −6 | −48 |

[1]According to ASTM D 445

[2]According to ASTM D 2270

[3]According to ASTM D 5950

TABLE 2

| Component [wt. %] | Example 1 | Example 2 | Example 3 | Comp. Ex. 1 | Comp. Ex. 2 | Comp. Ex. 3 | Comp. Ex. 4 |
|---|---|---|---|---|---|---|---|
| Base oil 1 [BS] | 34.1 | 50.6 | 54.8 | — | 27.9 | 15.1 | 73.2 |
| Base oil 2 [GTL 3] | — | — | 18.4 | — | — | — | — |
| Base oil 3 [GTL 4] | — | 22.6 | — | — | — | — | — |
| Base oil 4 [GTL 8] | 39.1 | — | — | — | — | — | — |
| Base oil 5 [HVI 130] | — | — | — | 45.3 | 45.3 | — | — |
| Base oil 6 [HVI 650] | — | — | — | 27.9 | — | — | — |
| Base oil 7 [Indopol H-7] | — | — | — | — | — | 58.1 | — |
| Additive package | 26.8 | 26.8 | 26.8 | 26.8 | 26.8 | 26.8 | 26.8 |
| TOTAL | 100 | 100 | 100 | 100 | 100 | 100 | 100 |
| Properties of the total composition | | | | | | | |
| Kinematic viscosity at 40° C.[1] [cSt] | 207.4 | 215.4 | 208.2 | 230.4 | 236.1 | 225.4 | 772.8 |
| Kinematic viscosity at 100° C.[1] [cSt] | 19.7 | 19.5 | 19.0 | 19.8 | 19.5 | 19.2 | 39.6 |
| VI[2] | 109 | 103 | 103 | 99 | 94 | 96 | 88 |
| TBN value[3] [mg/KOH/g] | 70 | 70 | 70 | 70 | 70 | 70 | 70 |

[1]According to ASTM D 445

[2]According to ASTM D 2270

[3]Accoprding to ASTM D 4739

TABLE 3

| | Example 1 | Example 2 | Example 3 | Comp. Ex. 1 | Comp. Ex. 2 | Comp. Ex. 3 | Comp. Ex. 4 |
|---|---|---|---|---|---|---|---|
| Wear [mm] | 0.30 | 0.32 | 0.35 | 0.33 | 0.35 | 0.38 | 0.40 |
| RPVOT at 150° C. [min] | 72 | 72.5 | 73 | 57 | 58.5 | 54 | 69 |

Discussion

As can be learned from Tables 1-3, it has been surprisingly found according to the present invention that it is possible to formulate a marine cylinder oil using a naphthenic bright stock base oil having a suitable VI (i.e. above 95) and kinematic viscosity.

Further, as can be seen from Table 3, the compositions according to the present invention even outperformed a marine cylinder oil based on normal mineral derived base oils (Comparative Examples 1-2 which contained the same additive package as the formulation of Examples 1-3) in terms of oxidation stability, whilst achieving a desirable anti-wear performance.

Further, the Examples according to the present invention also outperformed a marine cylinder oil based on naphthenic bright stock base oil only (Comparative Example 4 which contained the same additive package as the formulation of Examples 1-3, but no Fischer-Tropsch derived base oil) in terms of oxidation stability and anti-wear performance. Furthermore, Comparative Example 4 did not have the desired VI value of above 95.

We claim:

1. A functional fluid composition comprising:

a naphthenic bright stock base oil; and a Fischer-Tropsch derived base oil, wherein the functional fluid composition has a Viscosity Index (according to ASTM D 2270) of above 95.

2. The functional fluid composition according to claim 1, wherein the naphthenic bright stock base oil has a pour point of below −9° C. (according to ASTM D 5950).

3. The functional fluid composition according to claim 1 wherein the naphthenic bright stock base oil has a Viscosity Index (according to ASTM D 2270) of below 97.

4. The functional fluid composition according to claim 1 wherein the Fischer-Tropsch derived base oil has a kinematic viscosity at 100° C. of above 7.0 cSt.

5. The functional fluid composition according to claim 1 having a Viscosity Index of above 100.

6. The functional fluid composition according to claim 1 having a Total Base Number (TBN) value (according to ASTM D 4739) of above 35 and below 75 mg KOH/g.

7. The functional fluid composition according to claim 1 comprising less than 1.0 wt. % of polyisobutylene (PIB).

8. The functional fluid composition according to claim 1 comprising at least 20 wt. % of the naphthenic bright stock base oil, based on the total weight of the composition.

9. The functional fluid composition according to claim 1 being a marine cylinder oil.

10. The functional fluid composition according to claim 1, wherein the naphthenic bright stock base oil has a pour point of below 12° C.

11. The functional fluid composition according to claim 1 wherein the Fischer-Tropsch derived base oil has a kinematic viscosity at 100° C. of above 3.0 cSt.

12. A method comprising:

applying a lubricating composition to a surface in relative movement to another surface in a marine diesel engine, wherein the lubricating composition comprises:

a naphthenic bright stock base oil; and a Fischer-Tropsch derived base oil, wherein the lubricating composition has a Viscosity Index (according to ASTM D 2270) of above 95.

13. The method of claim 12 wherein the naphthenic bright stock base oil has a pour point of below −9° C. (according to ASTM D 5950).

14. The method of claim 12 wherein the naphthenic bright stock base oil has a Viscosity Index (according to ASTM D 2270) of below 97.

15. The method of claim 12 wherein the Fischer-Tropsch derived base oil has a kinematic viscosity at 100° C. of above 3.0 cSt.

16. The method of claim 12 wherein the Fischer-Tropsch derived base oil has a kinematic viscosity at 100° C. of above 7.0 cSt.

17. The method of claim 12 wherein the lubricating composition comprises at least 20 wt. % of the naphthenic bright stock base oil, based on the total weight of the composition.

18. The method of claim 12 wherein the lubricating composition has a Viscosity Index of above 100.

19. The method of claim 12 wherein the lubricating composition has a Total Base Number (TBN) value (according to ASTM D 4739) of above 35 and below 75 mg KOH/g.

20. The method of claim 12 wherein the lubricating composition comprises less than 1.0 wt. % of polyisobutylene (PIB).

* * * * *